United States Patent [19]

Giacone

[11] 4,285,606

[45] * Aug. 25, 1981

[54] ARRANGEMENT FOR DRIVING A PRINTING HEAD ALONG A PRINTING LINE

[75] Inventor: Felice Giacone, Giaveno, Italy

[73] Assignee: Ing. C. Olivetti & C., S.p.A., Italy

[ * ] Notice: The portion of the term of this patent subsequent to Jul. 12, 1994, has been disclaimed.

[21] Appl. No.: 933,426

[22] Filed: Aug. 14, 1978

Related U.S. Application Data

[63] Continuation of Ser. No. 745,321, Nov. 26, 1976, abandoned, which is a continuation of Ser. No. 575,758, May 8, 1975, Pat. No. 4,034,842.

[30] Foreign Application Priority Data

May 10, 1974 [IT] Italy ..... 68471 A/74

[51] Int. Cl.[3] ..... B41J 19/30; B41J 19/70

[52] U.S. Cl. ..... 400/317.1; 400/322

[58] Field of Search ..... 400/120, 320, 322, 328, 400/317, 342, 611, 617, 618, 636, 636.2, 317.1, 568, 569; 101/93.04, 93.05

[56] References Cited

U.S. PATENT DOCUMENTS

| | | | |
|---|---|---|---|
| 2,664,988 | 1/1954 | Metzner | 400/617 X |
| 3,292,530 | 12/1966 | Martin | 400/280 X |
| 3,628,645 | 12/1971 | McFeaters et al. | 400/317 X |
| 3,854,563 | 12/1974 | Cowardin et al. | 400/658 X |
| 3,855,448 | 12/1974 | Hanagata | 400/120 X |
| 3,858,702 | 1/1975 | Azuma | 400/317.1 X |
| 3,865,033 | 2/1975 | Taguchi et al. | 101/228 X |
| 3,882,988 | 5/1975 | Sloan et al. | 400/317.1 |
| 3,910,395 | 10/1975 | Colglazier et al. | 400/124 |
| 4,034,842 | 7/1977 | Giacone | 400/280 X |
| 4,039,065 | 8/1977 | Seki et al. | 400/120 |

OTHER PUBLICATIONS

*D.C. Power Supply Handbook*, 1970, Hewlett-Packard Co., pp. 29-30.

*Primary Examiner*—Paul T. Sewell

*Attorney, Agent, or Firm*—Schuyler, Banner, Birch, McKie & Beckett

[57] ABSTRACT

An arrangement for driving the printing head along a printing line of a recording medium comprises a reversible direct-current electric motor which is coupled to the head for moving the latter forwards and backwards along the printing line. The head prints only during the forwards movement and during this movement the motor is supplied with a first voltage which causes the forwards movement of the head at a first substantially constant velocity. After the printing of a last character the head is moved away from the recording medium by an electromagnet and the motor is supplied with a second voltage which causes the backwards movement of the head at a second substantially constant velocity, greater than the first velocity. During the backwards movement of the head two rollers advance the recording medium and held it tensioned in correspondence with the printing line.

5 Claims, 6 Drawing Figures

ARRANGEMENT FOR DRIVING A PRINTING HEAD ALONG A PRINTING LINE

This is a continuation of application Ser. No. 745,321, abandoned, filed Nov. 26, 1976, which is a continuation of Ser. No. 575,758 filed May. 8, 1975, now U.S. Pat. No. 4,034,842.

BACKGROUND OF THE INVENTION

1. Field of the Invention

The present invention relates to an arrangement for moving a printing head, for example of the non-impact type, by means of a direct-current electric motor.

In printing devices in which the impression of the character to be printed takes place without impact of the character-bearing element against the recording medium, the use of direct-current electric motors is very convenient, above all where the printing head is very light. In this case, a motor of limited power is sufficient for producing the translation of the head.

2. Description of the Prior Art

An arrangement is known in which a direct-current electric motor rotates a transmission belt extending along the entire printing line. In this arrangement, two hooks carried by the belt engage alternately with a pin on the head to translate it at constant speed during the printing stage. Having arrived at the end of the printing line, the hook disengages itself from the pin and the head returns rapidly to the starting position, restored by a spring which is loaded during the printing stage.

This arrangement, however, has the disadvantage that the return of the head takes place abruptly and that suitable and complicated means must be provided for checking the head when it reaches the starting position. Moreover, even when the head has to print a few characters in a line, it must travel the length of the whole of the printing line before being able to return, with a consequent waste of time.

SUMMARY OF THE INVENTION

The object of the present invention is to control the movement of the printing head along the printing line in a simple and reliable manner by means of a direct-current electric motor, causing the head to return to the starting position in the shortest possible time.

According to the present invention, there is provided a printing arrangement for printing lines of characters comprising a printing head, a reversible direct-current electric motor coupled to the head for driving the head forwards and backwards along a printing line, depending on the direction of movement of the motor, and control means including a supply circuit arranged to feed a first voltage to the motor during a stage of printing a line of characters, to move the head forwards, and arranged to feed to the motor a second voltage which is of opposite polarity to and greater magnitude than the first voltage, in order to move the head backwards following printing of a line of characters.

BRIEF DESCRIPTION OF THE DRAWING

The invention will be described in more detail, by way of example, with reference to the accompanying drawings, wherein.

DESCRIPTION OF A PREFERRED EMBODIMENT OF THE INVENTION

Figure 1:
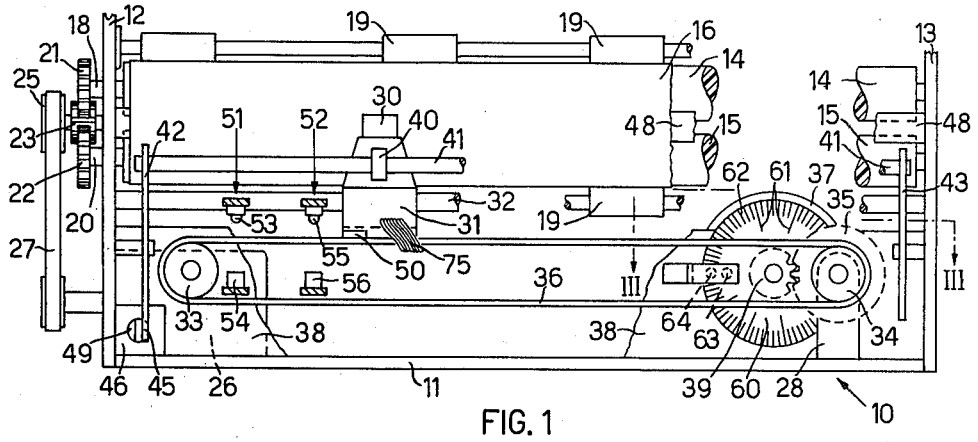
FIG. 1 is a front view, partly in section, of a printer with an arrangement embodying the invention.
Figure 2:
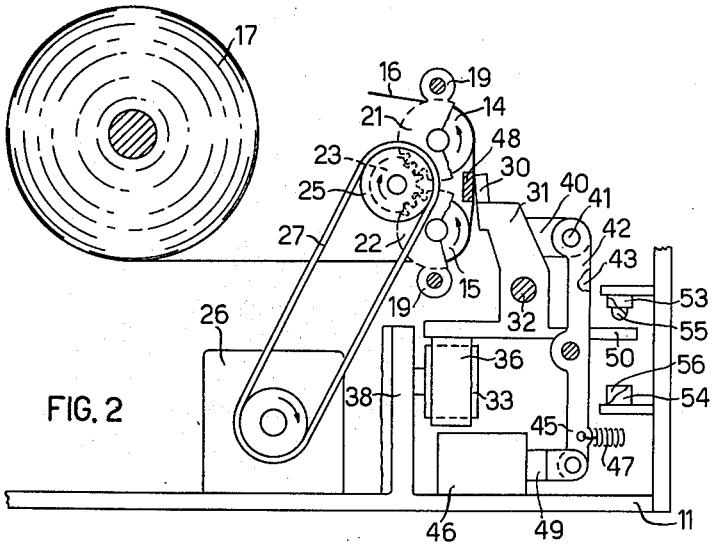
FIG. 2 is a side view from the left, partly in section and on a larger scale, of the printer of FIG. 1.

A printer 10 (FIG. 1) includes a frame 11 having a pair of parallel supporting sides 12 and 13 between which two rollers 14 and 15 are rotatably mounted. The rollers 14 and 15 draw along with them a sheet of paper 16 which is unwound from a roll 17 (FIG. 2) mounted rotatably on the sides 12 and 13. These rollers 14 and 15 are mounted one above the other and the upper roller 14 has a diameter slightly larger than that of the lower roller 15. For example, in the case of rubber rollers having a diameter of about 14 mm, the roller 14 has a diameter 0.1 to 0.4 mm larger than that of the roller 15. The rollers 14 and 15 have keyed to one of their ends 18 and 20, respectively, gears 21 and 22 of equal diameter and meshing with a single pinion 23 mounted rotatably on the side 12. Pressure rollers 19 are disposed in known manner above the roller 14 and below the roller 15 (FIGS. 1 and 2). A pulley 25 is keyed to the pinion 23, the pulley being connected to a stepping motor 26 by a transmission belt 27.

A carriage 31 of plastics material is slidable on a horizontal shaft 32 mounted on the sides 12 and 13 and has mounted removably thereon a printing head 30 known per se, for example of the electrothermal type described in our U.S. Pat. No. 3,777,116 and comprising a set of seven vertically aligned printing elements (not shown). A backing plate 48 (FIGS. 1 and 2) spans the sides 12 and 13 on the opposite side of the paper 16 from the head 30.

The carriage 31 is fast with a transmission belt 36 extending between two pulleys 33 and 34, one on a rib 38 and the other on a vertical lug 28 of the frame 11. The pulley 34 is connected by a gear 35 (FIGS. 1 and 3) to a pinion 39 of a reversible direct-current electric motor 37 mounted on the rib 38 of the frame 11. The carriage 31 has an upper lug 40 slidable along a horizontal bar 41 mounted on two substantially vertical levers 42 and 43 pivoted on the sides 12 and 13. By means of springs 47, only one of which can be seen in the drawing, the levers 42 and 43 normally hold the head 30 constantly in contact with the sheet of paper 16, while the lever 42 has its lower end 45 connected to the armature 49 of an electromagnet 46 for moving the head 30 away from the sheet of paper 16.

The carriage 31 has a horizontal lug 50 at the bottom which is adapted to co-operate with a pair of photodetectors 51 and 52. The photodetector 51 is constituted by a lamp 53 and a phototransistor 54 and is arranged on the frame 11 in the proximity of the left-hand end of the printing line and defines the beginning-of-line position. The photodetector 52 is constituted by a lamp 55 and a phototransistor 56, being also arranged on the frame 11 at an intermediate point of the printing line close to the photodetector 51.

On the shaft of the motor 37 (FIG. 1) there is keyed a synchronizing disc 60 provided with a first series of radial slits 61 angularly equidistant from one another. Also formed in the disc 60 is a second series of radial slits 62 shorter than the first-mentioned slits, also angularly equidistant from one another and arranged, in groups of six, between two successive slits 61.

Figure 3:
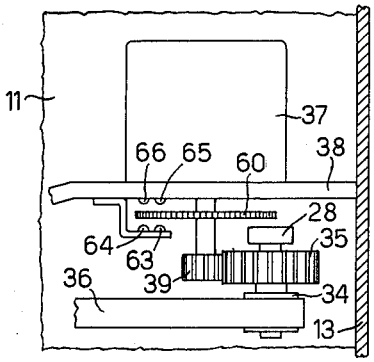
FIG. 3 is a section on the line III—III of FIG. 1.

In correspondence with the slits 61 and 62 there are arranged another two phototransistors 63 and 64 which co-operate with two corresponding lamps 65 and 66 (FIG. 3). The phototransistor 64 is adapted to detect the elementary movements of the head 30 along the printing line, which movements, in the case of printing in a matrix of dots, correspond to the distance between two successive columns of the matrix. The phototransistor 63 is adapted to detect the movements of the head 30 along the printing line between two successive characters.

The control circuit of the printer 10 comprises a controller 70 (FIG. 4), a supply circuit 71 for the direct-current motor 37, and a driving circuit 72. Moreover, the signals from the phototransistors 54, 56, 63 and 64 are sent to four corresponding squaring circuits 102, 103, 104 and 105, (FIG. 4), known per se. The timing signals supplied by the squaring circuits 102, 103, 104 and 105 are FR, FB, FC and FP, respectively, and are of logical 0 level when the corresponding phototransistor receives the light emitted by the corresponding emitter, and are of logical 1 level when the light beam is interrupted.

The controller 70 (FIG. 4) includes a selector circuit 74 known per se, which supplies as output, on seven conductors 75, the commands for energising the seven printing elements of the head 30. The selector circuit 74 receives the commands for printing from a central unit 76 which receives, from a memory not shown in the drawings, the text to be printed, storing the codes of the characters to be printed in a line. The enabling of energisation of the individual printing elements is effected by a read-only memory (ROM) 77 known per se, which receives serially from the central unit 76 the character and column addresses for each character to be printed. Moreover, the flow of operations of the central unit 76 is conditioned by the timing signals FC and FP from the phototransistors 63 and 64. These signals FC and FP are also sent to a counter 79.

The central unit 76 sends to a register 80 the code of the number of characters to be printed for each line. The register 80 and the counter 79 are connected to a comparator circuit 81 which is adapted to provide a signal CX of zero logical level when the codes contained in the register 80 and the counter 79 coincide with each other. The central unit 76 moreover sends to the driving circuit 72 corresponding signals VC, AZ and TZ suitably timed, as will be seen hereinafter, respectively for the starting of the printing of one or more lines of print and the zeroizing of the driving circuit 72.

The supply circuit 71 for the reversible direct-current motor 37 comprises a voltage source 83 and a voltage divider 85 which supplies different voltages on three lines 86, 87 and 88 to three corresponding field-effect transistors (FETs) 90, 91 and 92. The voltages supplied on the lines 86 and 87 are of opposite polarity to that supplied on the line 88. The voltages supplied on the lines 87 and 88 have substantially the same magnitude while the voltage supplied on the line 86 has a higher magnitude.

The transistors 90, 91 and 92 are connected to a first input 93 of an operational amplifier 95. The output of the latter is connected to a power circuit 96 known per se, which is connected to one terminal 97 of the motor 37. The other terminal 99 of the motor 37 is earthed through a resistor $R_S$ having a value equal to the internal resistance of the motor 37. A positive-feedback signal is picked off at the end of the resistor $R_S$ and is fed to a second input 100 of the amplifier 95, to be added algebraically to the command signal arriving at the input 93 and keep the speed of rotation of the motor 37 itself constant, in a manner known per se.

The driving circuit 72 (FIG. 5) includes a monostable multivibrator 108, at the input of which the zeroizing signal AZ arrives from the central unit 76 (FIG. 4) or, in any other known manner, from a control console 142. The multivibrator 108 (FIG. 5) generates a signal CP which is sent, through an inverter 109, to an input of a NAND gate 107, to the other input of which the signal FR is applied. The signal MB from the NAND gate 107 acts as a clock signal for a flip-flop 110 of the master-slave type known per se, which has the signal AZ as direct reset input. The outputs of the flip-flop 110 are RC and $\overline{RC}$.

The signal RC acts as an enabling signal for a flip-flop 111 of master-slave type which has as clock signal the signal VC supplied by the central unit 76 (FIG. 4) or from the control console 142. The flip-flop 111 (FIG. 5) has a signal WZ as direct reset input. This signal WZ originates from the output of an OR-WIRED connection between an inverter 112, which has the signal $\overline{AZ}$ as input, and a NAND gate 113, which has the signals FR, $\overline{FP}$ and ND as input. The outputs of the flip-flop 111 are ST and $\overline{ST}$.

Figure 4:
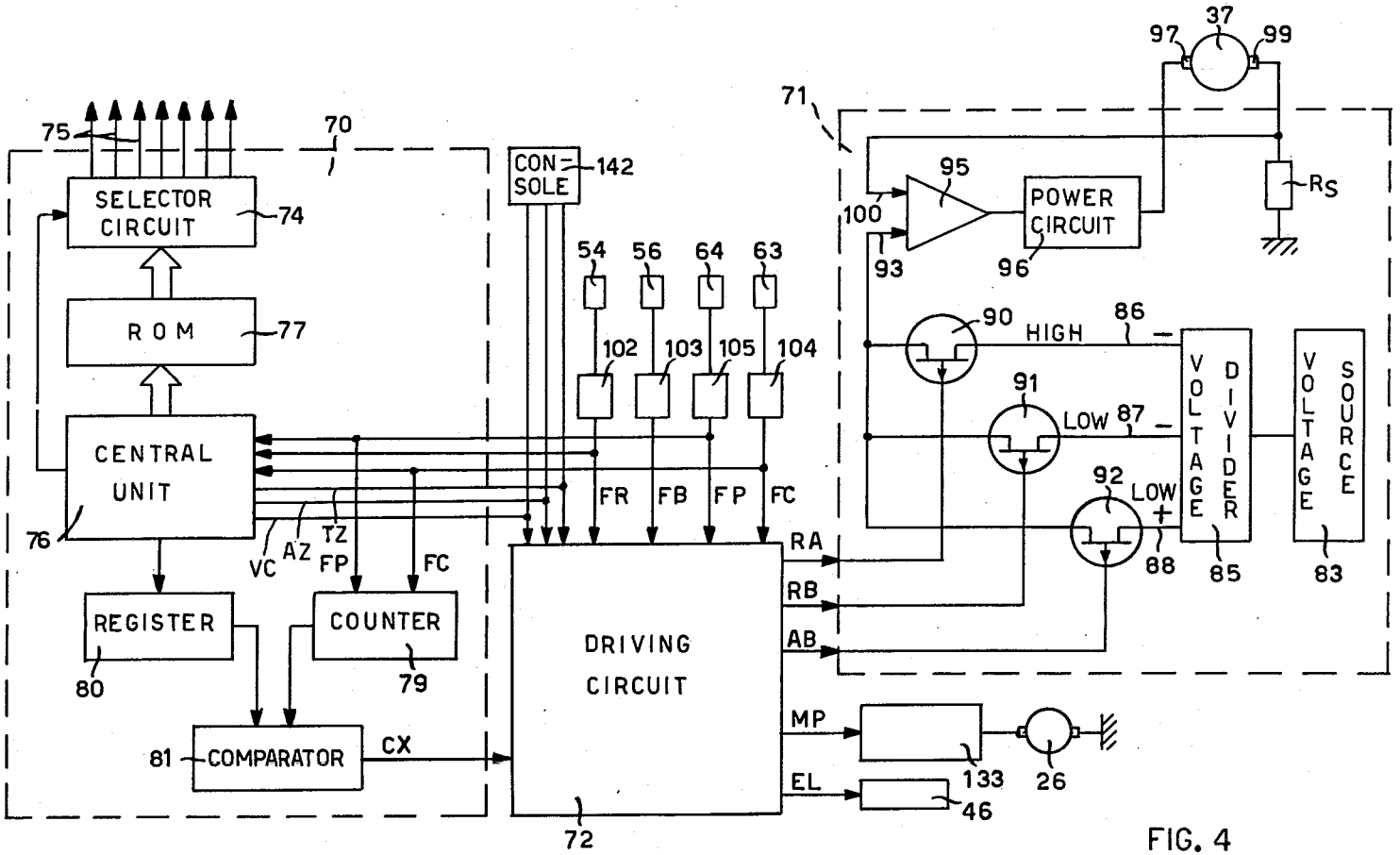
FIG. 4 is a block diagram of the control circuit of the printer of FIG. 1.
Figure 5:
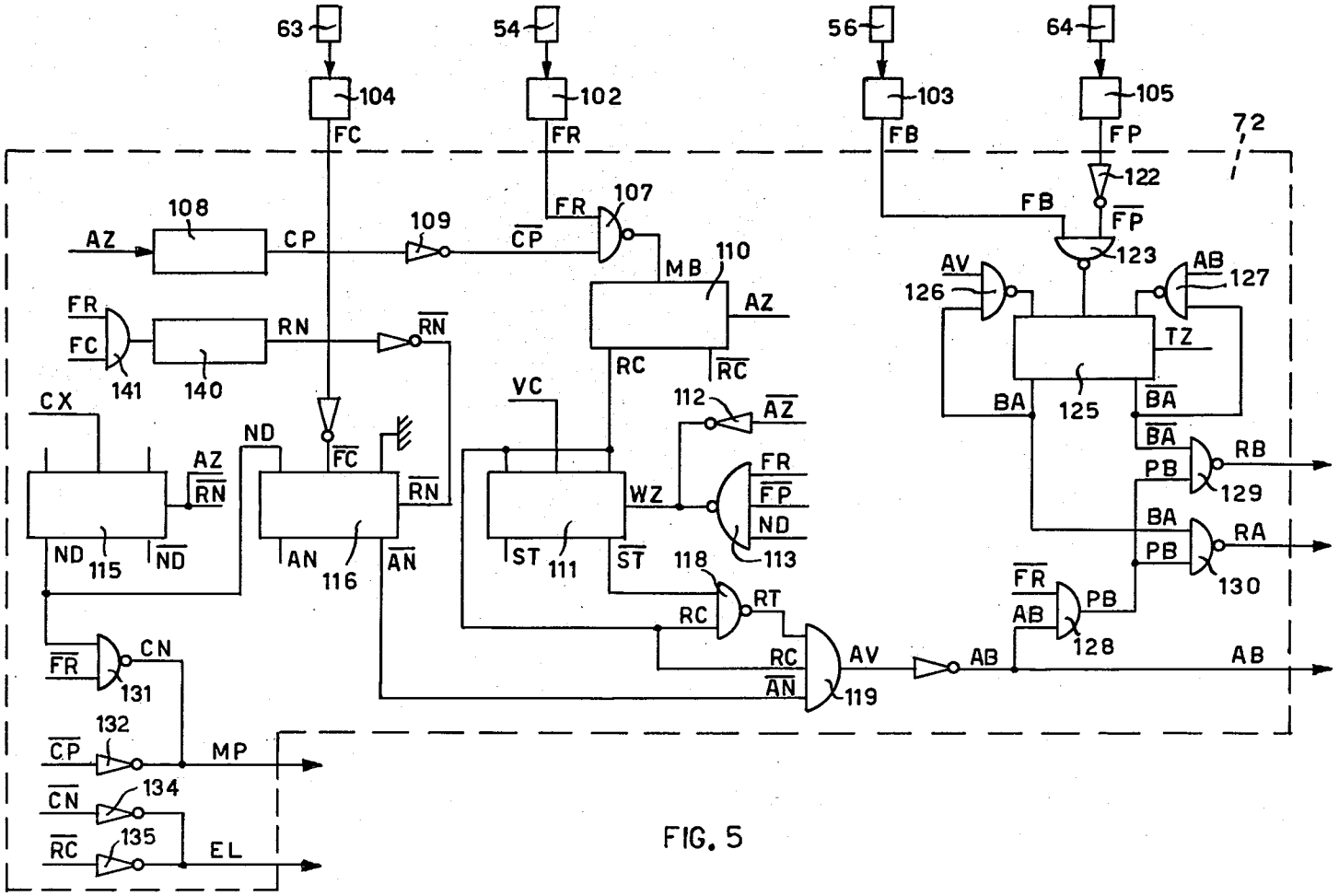
FIG. 5 is a logic diagram of a detail of the circuit of FIG. 4.

The signal ND originates from an output of a flip-flop 115 of master-slave type, which has as clock signal the signal CX generated by the comparator circuit 81 (FIG. 4). The enabling inputs of the flip-flop 115 (FIG. 5) are open and its direct reset input is provided by the OR-WIRED connection between the signals AZ and $\overline{RN}$. The signal RN is generated by a monostable multivibrator 140 which has as input the output of an AND gate 141 at whose inputs the signals FC and FR arrive. Moreover, the signal ND also acts as an enabling input to a flip-flop 116 of master-slave type, which has its other enabling input earthed and the signal $\overline{FC}$ as clock signal. The flip-flop 116 has as direct reset input the signal $\overline{RN}$ and as output the signals AN and $\overline{AN}$.

The signals $\overline{ST}$ and RC are applied to the inputs of a NAND gate 118, which generates a signal RT which is applied in turn to one input of an AND gate 119, which has the signals RC and $\overline{AN}$ present at the other inputs. The AND gate 119 gives the signal AV as output; the signal AB, which is the negated version of the signal AV, is sent to the transistor 92 (FIG. 4) to establish across the terminals of the amplifier 95 a voltage such as to cause the rotor of the motor 37 (FIG. 1) to turn anticlockwise at low speed.

The signal FP from the squaring circuit 105 (FIG. 5) is inverted by an inverter 122 and, together with the signal FB, is applied to the inputs of a NAND gate 123, the output of which acts as a clock signal for a flip-flop 125 of the master-slave type. The outputs of the flip-flop 125 are BA and $\overline{BA}$ and the enabling inputs are provided by the outputs of two NAND gates 126 and 127, the first of which has as inputs the signals AV and BA and the second the signals AB and $\overline{BA}$. The direct reset input of the flip-flop 125 is the signal TZ, which is generated by the central unit 76 (FIG. 4) or by the control console 142, on the switching on of the machine, and which remains at 1 level throughout the time during which the machine remains switched on.

The signals AB and $\overline{FR}$ (FIG. 5) are applied to the inputs of an AND gate 128 which gives a signal PB as output. This signal passes to one input of a NAND gate 129, which has the signal $\overline{BA}$ at its other input, and to one input of a NAND gate 130, which has the signal BA at its other input. The signals RB and RA from the NAND gates 129 and 130 are sent to the transistors 91 and 90 (FIG. 4). In this way, they establish at the amplifier 95 voltages opposite to that generated by the transistor 92 and which are respectively low and high to cause the rotor of the motor 37 (FIG. 1) to rotate clockwise at low and high speed, respectively.

The signal ND and the signal $\overline{FR}$ (FIG. 5) go to the inputs of a NAND gate 131 which has a signal CN as output. This signal is combined in OR-WIRED connection with the output of an inverter 132, which has the signal $\overline{CP}$ as input, and the signal MP which issues from this connection is sent to a circuit 133 (FIG. 4) which controls the rotation of the stepping motor 26 to produce the advance of the paper 16.

A signal EL (FIG. 5), which is the output of an OR-WIRED connection between two inverters 134 and 135 which are energized in their turn by the signals $\overline{CN}$ and $\overline{RC}$, respectively, is sent to the electromagnet 46 (FIGS. 1, 2 and 4).

Let it be assuumed that it is desired to print one or more lines of print on the sheet of paper 16. In the initial position, the carriage 31 and the printing head 30 (FIG. 1) are located at the left-hand end of their path, with the lug 50 of the carriage 31 interposed between the lamp 53 and the phototransistor 54. The signal FR (FIG. 6) is therefore at logical 1 level. Moreover, the phototransistor 56 picks up light from the lamp 55 and generates the signal FB of logical 0 level. Finally, the synchronizing disc 60 does not present any slit 61 or 62 between the phototransistors 63 and 64 (FIG. 3) and the emitters 65 and 66 opposite them, as a result of which the signals FC and FP are at logical 1 level.

On switching on the machine from the control console 142 or directly from the central unit 76 (FIG. 4), the zeroizing signals AZ and TZ of logical 1 level are generated. The monostable multivibrator 108 (FIG. 5) generates the signal CP of level 1 for a predetermined time. Moreover, the flip-flop 110 has its outputs at the levels RC=0 and $\overline{RC}$=1 and the flip-flop 115 has its outputs at the levels ND=0 and $\overline{ND}$=1. The flip-flop 125 has its outputs at the levels BA=0 and $\overline{BA}$=1.

The inverted signal $\overline{RN}$ from the multivibrator 140 is at level 1 and disposes the flip-flop 116 (FIG. 5) with its outputs AN=0 and $\overline{AN}$=1. On switching on of the machine, therefore, AV=RC.RT.$\overline{AN}$=0; AB=$\overline{AV}$=1; PB=$\overline{FR}$.AB=0, $\overline{FR}$ being equal to 0, RA=PB.$\overline{BA}$=1 and RB=PB.$\overline{BA}$=1, irrespective of the value of the signals BA and $\overline{BA}$. Therefore, the signals AB, RA and RB, which go to control the three transistors 92, 90 and 91 (FIG. 4), are all brought to logical 1 level (see also FIG. 6), none of these transistors is turned on and the motor 37, not being supplied, remains stationary.

Still on the switching on of the machine, moreover, the signals ST and $\overline{ST}$ from the flip-flop 111, are brought to the levels ST=0 and $\overline{ST}$=1, the signal WZ being brought to level 1. The signal MB, which has gone to level 1 with the signal CP generated by the multivibrator 108, goes to level 0 when the signal SP goes to level 0. The signal MB thus causes the flip-flop 110 to change over and brings its outputs to the levels RC=1 and $\overline{RC}$=0. The signal RT passes to level 0 and the AND gate 119 maintains the signal AV at level 0, keeping the motor 37 stationary.

Still on the switching on of the machine, in the period during which CP is at level 1 and RC is at level 0, the signals EL and MP are brought to level 0. Consequently, the electromagnet 46 is energised and moves the head 30 (FIG. 2) away from the sheet of paper 16, while the circuit 133 (FIG. 4) causes the stepping motor 26 to start for the advance of the sheet of paper 16. With a rotation of the stepping motor 26 clockwise in FIG. 2, the draw rollers 14 and 15 both rotate anticlockwise and draw the paper along upwardly. The upper roller 14 being of larger diameter than the lower roller 15 and the paper 16 being pressed at the top and bottom by the pressure rollers 19, the sheet of paper 16 is pulled to a greater degree by the upper roller 14 and, as a consequence, the sheet 16 is kept taut in the zone between the two rollers 14 and 15.

When the central unit 76 (FIG. 4) or the control console 142 sends a positive pulse VC1 of the signal VC, which is normally at level 0, to the driving circuit 72, the starting of the movement of the printing head 30 in front of the sheet of paper 16 (FIG. 1) is obtained. When the signal VC passes from 1 to 0, it causes the flip-flop 111 (FIG. 5) to change over, the enabling signals RC being at level 1. The output signals ST and $\overline{ST}$ (see also FIG. 6) are therefore brought to the logical values ST=1 and $\overline{ST}$=0, therefore changing over the NAND gate 118 with RT=1. $\overline{AN}$ also being at level 1, the signal AV of the AND gate 119 goes to level 1 and the negated version thereof, the signal AB, is brought to level 0, rendering the transistor 92 conducting. Since, on the other hand, PB has remained at level 0, RA and RB also remain at level 1 and the transistors 90 and 91 remain turned off. The motor 37 is therefore supplied with a predetermined voltage which sets its rotor in anticlockwise rotation (FIG. 1). The carriage 31 moves from left to right, carried along by the belt 36. The lug 50 is brought beyond the light beam of the emitter 53. The signal FR output by the corresponding phototransistor 54 then passes from 1 to 0.

In spite of this, since the signal AB is at 0, the signal PB from the AND gate 128 still remains at level 0, the signals RA and RB remain at level 1 and the transistors 90 and 91 remain turned off. Moreover, because of the stabilization carried out on the motor 37 (FIG. 4) by the amplifier 95 and the resistor $R_S$, the carriage 31 (FIG. 1) moves at substantially constant speed along the printing line.

The central unit 76 (FIG. 4) now sends to the selector circuit 74 the information necessary for the printing of the individual characters and to the register 80 the code corresponding to the number of characters to be printed in the line. The circuit 74, in turn, sends the energising pulses from the printing elements of the head 30 on the conductors 75. Moreover, the synchronizing disc 60, rotating together with the rotor of the motor 37, sends to the central unit 76 and to the counter 79, through the medium of the phototransistors 63 and 64, the timing signals FP and FC, at each column of the matrix of dots and at each character in the line of print, respectively, synchronizing the movement of the head 30 with the printing of the individual dots.

Figure 6:
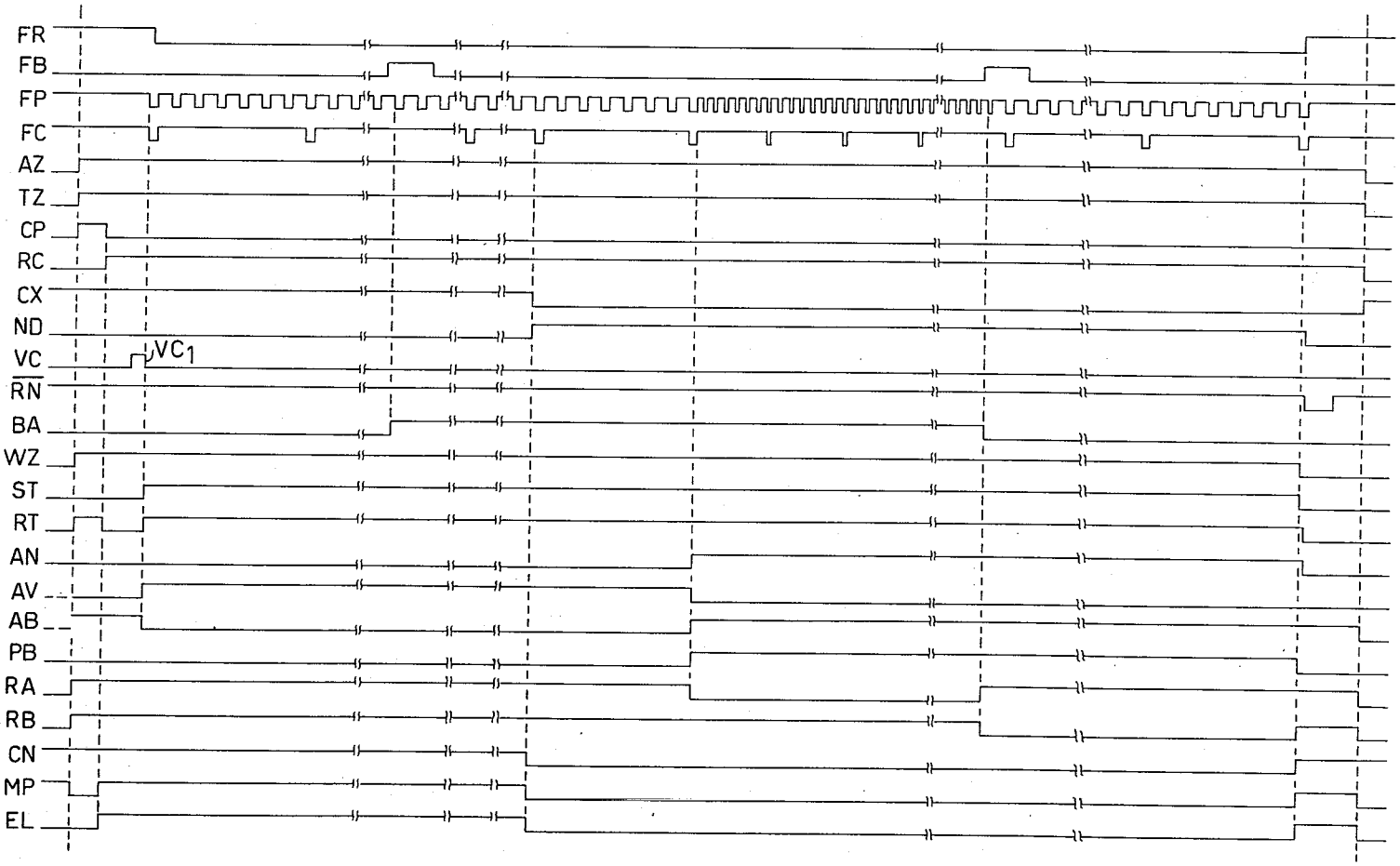
FIG. 6 is a timing diagram of a number of signals of the circuits of FIG. 4 and FIG. 5.

When the carriage 31 (FIG. 1), moving to the right, causes its lug 50 to break the light beam issuing from the lamp 55 (FIG. 5), the signal FB from the phototransistor 56 passes momentarily from 0 to 1 (see also FIG. 6). As soon as the signal $\overline{FP}$ is also at 1, the output of the NAND gate 123 passes from 1 to 0. Consequently, the enabling signals from the NAND gates 126 and 127 being at level 1 for the 0 level of AB and BA, the flip-flop 125 is changed over and the signals BA and $\overline{BA}$ are brought to the levels BA=1 and $\overline{BA}$=0. This does not, however, modify the conditions of the signals RA and RB, the signal PB having remained at logical level 0, so that the motor 37 (FIG. 1) continues to rotate anticlockwise and at low speed.

When the printing head 30 completes the printing of the line, the counter 79 (FIG. 4) reaches the same configuration as the code stored in the register 80, the comparator circuit 81 detects the match and causes the signal CX to pass from level 1 to 0. The flip-flop 115 (FIG. 5) is changed over and the signals ND and $\overline{ND}$ are brought to the logical levels ND=1 and $\overline{ND}$=0, thus enabling the flip-flop 116. When, by further movement by one character, the disc 60 changes the signal $\overline{FC}$ over from 1 to 0, the flip-flop 116 changes the signal $\overline{AN}$ over to 0 and, consequently, the signal AV to 0. The signal AB goes to 1, turning off the transistor 92 (FIG. 4), which thus interrupts the supply to the motor 37.

When the signal AB changes from 0 to 1, the signal PB=$\overline{FR}$.AB changes from 0 to 1. Therefore, $\overline{BA}$ being at 0, the signal RB=$\overline{BA.PB}$ remains at 1, while the signal RA=$\overline{BA.PB}$, passing from 1 to 0, renders the transistor 90 (FIG. 4) conducting, keeping the transistors 91 and 92 turned off. The motor 37 is thus supplied with a voltage which is higher than, and of opposite polarity to, that with which it was being supplied during the printing stage. Consequently, the carriage 31 and the head 30 are brought back to the inoperative position at a return speed higher than the printing speed.

Simultaneously with the reversal of the rotation of the motor 37, there takes place command of the stepping motor 26, which moves the paper 16 on to effect line spacing, and command of the electromagnet 46, which effects the moving of the printing head 30 away from the sheet of paper 16. More particularly, the signal ND (see also FIG. 6), passing from 0 to 1, causes the signals CN and MP to pass from 1 to 0. The signal MP then causes the circuit 133 to generate a series of pulses which command the rotation of the stepping motor 26, in accordance with a predetermined line spacing programme, while through the medium of the inverter 134 the signal $\overline{CN}$ causes the signal EL to pass from 1 to 0, energising the electromagnet 46.

During the state of return of the carriage 31 (FIG. 1) towards the position of rest, when the lug 50 passes through the photodetector 52, the signal FB generated by the corresponding phototransistor 56 again passes momentarily from level 0 to level 1. At the instant when the signals FB and $\overline{FP}$ are both at level 1, the output of the NAND gate 123 (FIG. 5) passes from 1 to 0 and causes the flip-flop 125 to change over, the enabling inputs of the latter both being at level 1. The signals from the flip-flop 125 therefore become BA=0 and $\overline{BA}$=1. Consequently, the signal RA passes from 0 to 1, while the signal RB passes from 1 to 0. Thus, the transistor 91 (FIG. 4) is turned on, while the transistors 90 and 92 are turned off. The motor 37 is now supplied with a voltage which is lower and such as to cause it to rotate at low speed and still clockwise (FIG. 1), giving a slow final approach to the starting position.

When the carriage 31 and the head 30 arrive at the starting position at low speed, the lug 50 is interposed between the lamp 53 and the phototransistor 54. The signal FR therefore changes from 0 to 1, the AND gate 128 changes the signal PB over to 0 and, consequently, the signal RB also passes to level 1 and also turns off the transistor 91, stopping the motor 37.

Moreover, when the signal FR passes to level 1, the signal WZ also goes to 0, the signal $\overline{FP}$ and ND being both at level 1, and restores in the flip-flop 111 (FIG. 5) the initial conditions of ST=0. The monostable multivibrator 140, in turn, in response to the last pulse of the signal FC, through the AND gate 141, causes the signal RN to pass from 0 to 1, then to cause it to pass again to level 0 after a predetermined time (FIG. 6). The signal $\overline{RN}$, passing from 1 to 0, causes the flip-flops 115 and 116 (FIG. 5) to change over, bringing them into the initial states with the signals ND and AN at 0 and the signals $\overline{ND}$ and $\overline{AN}$ at 1. Therefore, if another positive pulse of the signal VC arrives from the central unit 76 (FIG. 4) or from the control console 142, a new printing cycle takes place in the manner hereinbefore described.

If the characters to be printed in a line are very few in number, the last character iss printed before the carriage 31 (FIG. 1) has caused its lug 50 to break the light beam issuing from the emitter 55. The signal FB generated by the phototransistor 56 remains at level 0 and the outputs of the flip-flop 125 (FIG. 5) remain as BA=0 and $\overline{BA}$=1. Consequently, when the comparator circuit 81 causes the signal CX to pass from 1 to 0, in coincidence with the last character printed, through the medium of the flip-flops 115 and 116, and the AND gate 119, the signal AB passes from level 0 to level 1, turning off the transistor 92 (FIG. 4). The signal RA remains at level 1, leaving the transistor 90 turned off, while the signal RB passes to level 0, turning on the transistor 91, which causes the rotor of the motor 37 to rotate clockwise (FIG. 1) at low speed. Therefore, the carriage 31 moves from left to right and from right to left substantially at the same low speed.

If, on the switching on of the machine, the carriage 31 is not in the starting position at the left-hand end of its path for any reason, the driving circuit 72 causes the motor 37 to turn at low speed until it brings the carriage 31 back into this starting position. In fact, the signal FR generated by the phototransistor 54 is in this case at 0, the signal MB (FIG. 5) remains at 1 and the signal RC from the flip-flop 110 is at 0. The AND gate 119 maintains the signal AB at 1 and the signal RA also at 1, the inputs of the NAND gate 130 being PB=1 and BA=0. The signal RB, on the other hand, is brought to 0, the inputs of the NAND gate 129, PB and $\overline{BA}$, both being at 1. Therefore, the transistor 91 is the only one to be conducting and the rotor of the motor 37 (FIG. 1) is caused to rotate clockwise at low speed. This situation persists even if during the return of the carriage 31 to the starting position the lug 50 interrupts the light beam of the emitter 55. In the latter case, when the signal FB from the phototransistor 56 passes from level 0 to level 1, the flip-flop 125 (FIG. 5) does not change over, its set enabling input from the gate 126 being at 1 and its reset enabling input from the gate 127 being at 0. The motor 37 (FIG. 1) therefore continues to rotate until such time as the carriage 31, having arrived at the inoperative position, interrupts with its lug 50 the light beam issuing from the lamp 53.

I claim:

1. In a printer having a printing head, means defining a rest position for said head, means for advancing said head along a plurality of printing positions of a printing line in front of a recording medium in a forward movement at a substantially constant advancing speed starting from said rest position, and start printing means for causing said printing head to begin printing during said forward movement starting from a first of said printing positions to define a printing stage of said head, the improvement comprising: means defining a predetermined position of said printing positions along said printing line, beyond said first printing position, detecting means for detecting the passage of said head through said predetermined position during said printing stage, memory means connected to said detecting means for storing whether said head during its forward movement has passed said predetermined position, first means for generating a signal indicative of a last character printed along said printing line, and second means controlled by said memory means and by said indicative signal for applying to said head a low return speed when said head has not reached said predetermined position during said printing stage and a high return speed of a value higher than said advancing speed when said head has passed said predetermined position during the printing stage.

2. A printer comprising a recording medium; a printing head; means defining a rest position at which said head is located when at rest; an electric motor connected to said head for moving said head in front of said medium along a plurality of printing positions of a substantially rectilinear path; first feeding means selectively coupled to said motor for causing said head to move at a substantially constant advancing speed in a forward movement from said rest position towards said printing positions during a printing stage of said head; start means for causing said head to begin printing starting from a first of said printing positions along said rectilinear path; detecting means located at a predetermined position along said path beyond said first printing position for detecting the passage of said head; memory means connected to said detecting means for storing whether said head during its forward movement has passed said predetermined position; means for generating a signal indicative of a last character printed during the printing stage; second feeding means selectively coupled to said motor for causing said head to move at a substantially constant high return speed of a value higher than said advancing speed in a backward movement thereof toward said rest position; third feeding means selectively coupled to said motor for causing said head to move at a substantially constant low return speed in a backward movement thereof toward said rest position; and driving means controlled by said memory means and by said indicative signal for connecting said second feeding means with said motor when said head has passed said predetermined position during said forward movement and for alternatively connecting said third feeding means with said motor when said head has not passed said predetermined position during said forward movement.

3. A printer comprising a recording medium, a printing head, means defining a rest position at which said head is located when at rest, a motor coupled to said head for moving said head in front of said medium along a substantially rectilinear path, first feeding means selectively coupled to said motor for causing said head to move at a substantially constant advancing speed in a forward movement starting from said rest position during a printing stage thereof, means for generating a signal indicative of a start of printing position on which a first character can be printed by said head along said rectilinear path, detecting means disposed at a predetermined position, beyond the start of printing position, along said path for detecting the passage of said head, memory means connected to said detecting means for storing whether said head during its forward movement has passed said predetermined position, means for generating a signal indicative of a last character printed along the printing line, second feeding means selectively coupled to said motor and cooperative with said memory means and with said signal for causing said head to move at a substantially constant high return speed of a value higher than said advancing speed in a backward movement thereof toward said rest position when said head during said forward movement has passed said predetermined position, and third feeding means selectively coupled to said motor and cooperative with said memory means and with said signal for causing said head to move at a substantially constant low return speed in a backward movement thereof toward said rest position when said head begins said backward movement from a position intermediate between said rest position and said predetermined position.

4. A printer as in claim 3, wherein said second feeding means is uncoupled from said motor and said third feeding means is coupled to said motor whenever said head passes through said predetermined position in said backward movement to give a low final return speed to said head as it approaches said rest position.

5. In a printer having a printing head movable at a substantially constant advancing speed in a forward movement in front of a recording medium along a printing line starting from a rest position, and means for causing said head to begin printing starting from said rest position the improvement comprising: means defining a predetermined position along said printing line beyond said rest position, detecting means for detecting a passage of said head through said predetermined position during said forward movement, memory means responsive to said detecting means for storing the passage of said head during its forward movement, first means for generating a signal indicative of a last character printed by said head along said printing line, second means controlled by said memory means and by said signal indicative of a last character printed for returning said head to said rest position, said second means applying to said head a low return speed when no passage of said head through said predetermined position is stored, and a high return speed of a value higher than said advancing speed when the passage of said head through said predetermined position is stored and third means for restoring said memory means when the passage of said head through said predetermined position is detected by said detecting means during the return of said head.

* * * * *